US007890322B2

(12) United States Patent
Dai et al.

(10) Patent No.: US 7,890,322 B2
(45) Date of Patent: Feb. 15, 2011

(54) METHOD AND APPARATUS FOR SPEECH SIGNAL PROCESSING

(75) Inventors: Jinliang Dai, Shenzhen (CN); Libin Zhang, Shenzhen (CN); Eyal Shlomot, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 12/820,738

(22) Filed: Jun. 22, 2010

(65) Prior Publication Data

US 2010/0250247 A1 Sep. 30, 2010

Related U.S. Application Data

(63) Continuation of application No. PCT/CN2009/070826, filed on Mar. 17, 2009.

(30) Foreign Application Priority Data

Mar. 20, 2008 (CN) ..... 2008 1 0026901

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS 5,351,338 A * 9/1994 Wigren ..... 704/219
5,572,622 A * 11/1996 Wigren et al. ..... 704/228
6,385,578 B1 5/2002 Lee et al.
6,453,289 B1 9/2002 Ertem et al.
6,584,441 B1 6/2003 Ojala et al.
6,604,071 B1 8/2003 Cox et al.

(Continued)

FOREIGN PATENT DOCUMENTS

CN 1367918 A 9/2002

(Continued)

OTHER PUBLICATIONS

Foreign communication from a counterpart application—PCT/CN2009/070826, International Search Report, dated Jun. 25, 2009, 4 pages.

(Continued)

*Primary Examiner*—Michael N Opsasnick
(74) *Attorney, Agent, or Firm*—Conley Rose, P.C.; Grant Rodolph

(57) ABSTRACT

A method for speech signal processing is provided. Energy attenuation gain values are set for background noise signals corresponding to obtained background noise frames subsequent to an erasure concealment frame, so that differences between the energy attenuation gain values of the background noise signals corresponding to the background noise frames and the energy attenuation gain values of signals corresponding to their respective previous frames are within a threshold range. Energy attenuation of the background noise signals corresponding to the background noise frames is controlled by using the energy attenuation gain values. An apparatus for speech signal processing is also provided in embodiments of the present invention. By using the embodiments of the present invention, the energy transition between the area of erasure concealment signal and the area of background noise signal may be made natural and smooth, so as to improve the audio comfortable sensation of the listener.

19 Claims, 3 Drawing Sheets

U.S. PATENT DOCUMENTS

| | | | |
|---|---|---|---|
| 6,757,395 | B1 | 6/2004 | Fang et al. |
| 6,804,640 | B1 | 10/2004 | Weintraub et al. |
| 7,003,455 | B1 | 2/2006 | Deng et al. |
| 7,191,123 | B1 | 3/2007 | Bessette et al. |
| 7,454,010 | B1 | 11/2008 | Ebenezer |
| 7,454,335 | B2 | 11/2008 | Gao et al. |
| 2007/0198254 | A1 | 8/2007 | Goto et al. |

FOREIGN PATENT DOCUMENTS

| | | | |
|---|---|---|---|
| CN | 1416564 | A | 5/2003 |
| CN | 1229775 | C | 11/2005 |
| CN | 1758694 | A | 4/2006 |
| CN | 1288557 | C | 12/2006 |
| CN | 1930607 | A | 3/2007 |
| CN | 101080766 | A | 11/2007 |
| CN | 101339766 | A | 1/2009 |
| EP | 1724758 | A2 | 2/2000 |
| EP | 1232494 | B1 | 11/2000 |
| EP | 1250703 | B1 | 1/2001 |
| EP | 0603854 | B1 | 3/2001 |
| EP | 1199712 | B1 | 10/2001 |
| EP | 1997101 | A2 | 12/2008 |
| JP | 8305395 | A | 11/1996 |
| WO | 9921167 | A1 | 4/1999 |
| WO | 0048171 | A1 | 2/2000 |
| WO | 0075919 | A1 | 12/2000 |
| WO | 0137264 | A1 | 5/2001 |
| WO | 0152242 | A1 | 7/2001 |
| WO | 2007111645 | A2 | 10/2007 |

OTHER PUBLICATIONS

"G.729 Based Embedded Variable Bit-Rate Coder: An 8-32 kbit/s Scalable Wideband Coder Bitstream Interoperable with G.729," Series G: Transmission Systems and Media, Digital Systems and Networks Digital Terminal Equipments—Coding of Analogue Signals by Methods Other Than PCM, ITU-T G.729.1 (May 2006).

"Coding of Speech at 8 kbit/s Using Conjugate Structure Algebraic-Code-Excited Linear-Prediction (CS-ACELP)," Series G: Transmission Systems and Media, Digital Systems and Networks Digital Terminal Equipments—Coding of Analogue Signals by Methods Other Than PCM, ITU-T G.729 Annex B (Nov. 1996).

* cited by examiner

METHOD AND APPARATUS FOR SPEECH SIGNAL PROCESSING

CROSS REFERENCE TO RELATED APPLICATIONS

This application is a continuation of International Application No. PCT/CN2009/070826, filed on Mar. 17, 2009, which claims priority to Chinese Patent Application No. 200810026901.2 filed on Mar. 20, 2008, both of which are hereby incorporated by reference in their entireties.

FIELD OF THE INVENTION

The present invention relates to the communications field, and more particularly, to a method for speech signal processing and an apparatus for speech signal processing.

BACKGROUND

In voice communication, speech signals are typically processed in unit of frames. The length of each frame of speech signals is generally 10 milliseconds (ms) to 30 ms. For each frame of speech signals, the basic processing process is as follows:

At a transmitter, each frame of speech signals is encoded by a speech encoder, and the encoded bits are packaged into a speech data frame; the speech data frame is transmitted via a communication channel from the transmitter to a receiver; at the receiver, the received speech data frame is decoded by a speech decoder, and the speech signal is recovered.

For a speech decoder, the recovering of a speech signal depends on the accurate reception of the speech data frame transmitted from the transmitter, and the accurate reception of the speech data frame depends on a communication channel. For the communication channel, if communication channel resources are insufficient, loss of speech data frame or error of speech data frame may occur. Currently, the impact on the communication quality of speech data frame caused by the loss of speech data frame or the error of speech data frame in the communication channel can be effectively eliminated by the Frame Erasure Concealment (FEC) technology widely used in the speech coder-decoder (CODEC).

The FEC technologies adopted by different speech CODECs may be different, but generally include operations for performing amplitude attenuation on recovered speech signals.

The FEC technology is employed in the speech CODEC to perform FEC processing on the speech data frame (corresponding to the erasure concealment frame). However, not all the speech signals are vocal signals purely produced by human voice, and the speech signals may also include background noise signals in human inactive intervals (relative to the vocal signal, the background noise signal is a non-speech signal). Energy jump may occur in the recovered signal processed by the erasure concealment because of the existence of the background noise signal (corresponding to the background noise frame produced by the speech encoder), this may cause discomfort to the hearing of the listener. Especially when the background noise frame is lost, the hearing discomfort caused by this kind of energy jump will become more serious.

SUMMARY

The technical problem to be solved by embodiments of the present invention is to provide a method and an apparatus for speech signal processing to make the energy transition between the area of erasure concealment signal and the area of background noise signal natural and smooth, so as to improve audio comfortable sensation of the listener.

To solve the above mentioned technical problem, embodiments of the present invention provide a method for speech signal processing. The method includes: when one or more background noise frames subsequent to an erasure concealment frame are obtained, setting energy attenuation gain values for background noise signals corresponding to the obtained background noise frames, to make differences between the energy attenuation gain values of the background noise signals corresponding to the background noise frames and the energy attenuation gain values of signals corresponding to their respective previous frames be within a threshold range; controlling energy attenuation of the background noise signals corresponding to the background noise frames by using the energy attenuation gain values.

Accordingly, embodiments of the present invention provide an apparatus for speech signal processing. The apparatus includes: a background noise frame obtaining unit adapted to obtain one or more background noise frames subsequent to an erasure concealment frame; an energy attenuation gain value setting unit adapted to set energy attenuation gain values for background noise signals corresponding to the obtained background noise frames, to make differences between the energy attenuation gain values of the background noise signals corresponding to the background noise frames and the energy attenuation gain values of signals corresponding to their respective previous frames be within a threshold range; a control unit adapted to control energy attenuation of the background noise signals corresponding to the background noise frames by using the energy attenuation gain values.

In embodiments of the present invention, the energy attenuation gain values are set for the background noise signals corresponding to the obtained background noise frames subsequent to an erasure concealment frame, so that the differences between the energy attenuation gain values of the background noise signals corresponding to the background noise frames and the energy attenuation gain values of signals corresponding to their respective previous frames are within the threshold range; and the energy attenuation of the background noise signals corresponding to the background noise frames is controlled by using the energy attenuation gain values. Therefore, the energy transition between the area of erasure concealment signal and the area of background noise signal may be natural and smooth by setting the energy attenuation gains of the background noise signals and performing energy attenuation on the background noise signals with the energy attenuation gains, and the audio comfortable sensation of the listener may be improved.

DETAILED DESCRIPTION

Embodiments of the present invention provide a method and an apparatus for speech signal processing, in which energy attenuation may be performed on the background noise signal by setting and using the energy attenuation gain of the background noise signal; therefore, the energy transition between the area of erasure concealment signal and the area of background noise signal may be natural and smooth, and the audio comfortable sensation of the listener may be improved.

In the following description, embodiments of the present invention will be described in detail in conjunction with the accompanying drawings.

Figure 1:
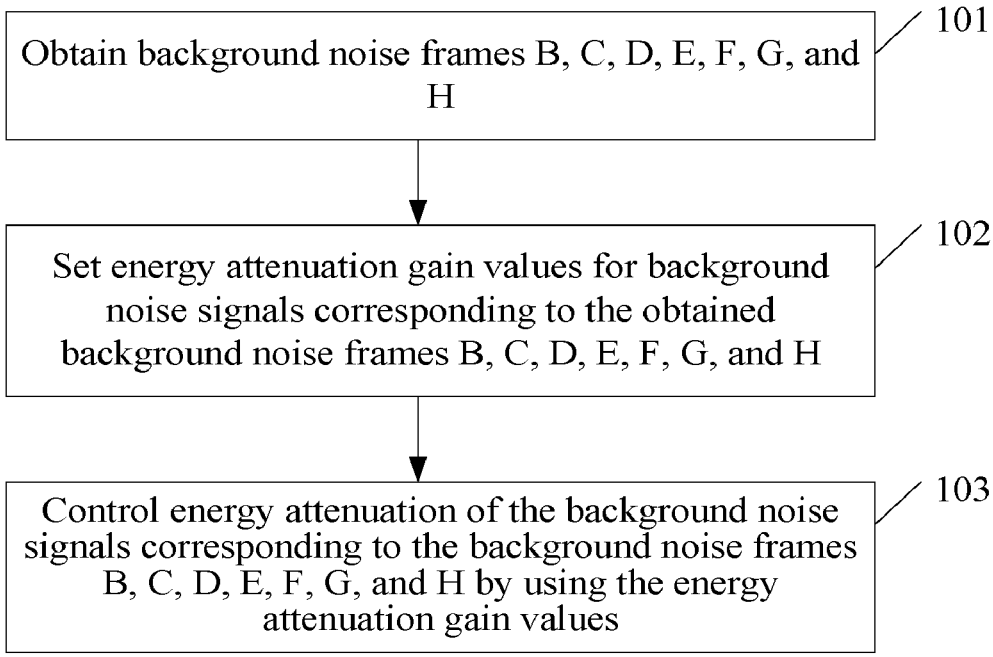
FIG. 1 is a schematic diagram of a method for speech signal processing according to an embodiment of the present invention.
Figure 2:
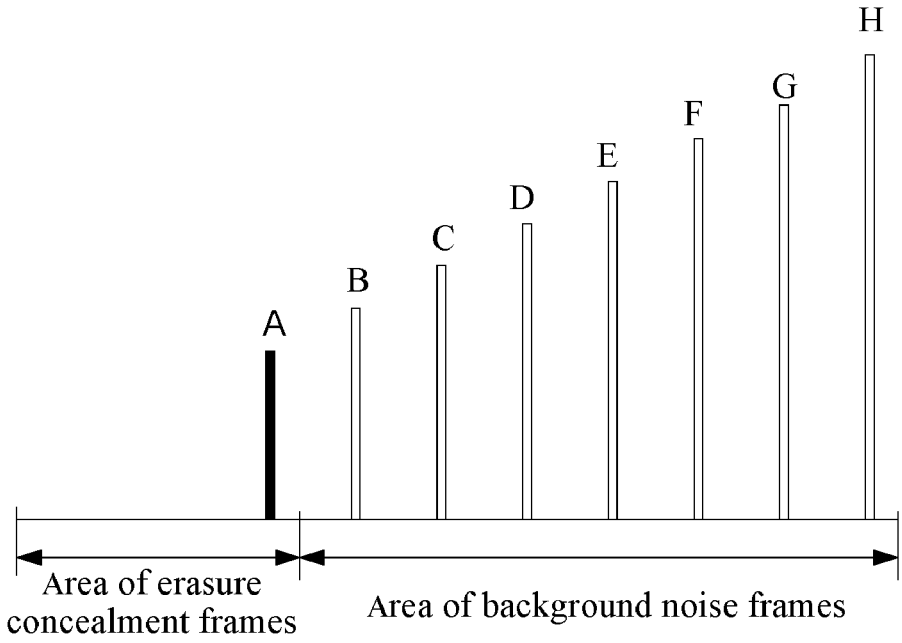
FIG. 2 is a schematic diagram of a speech signal amplitude obtained by speech signal processing according to an embodiment of the present invention.

FIG. 1 is a schematic diagram of a method for speech signal processing according to an embodiment of the present invention. FIG. 2 is a schematic diagram of a speech signal amplitude obtained by speech signal processing according to an embodiment of the present invention. Referring to FIG. 1 and FIG. 2, the method shown in FIG. 1 mainly includes the following steps.

101: One or more background noise frames subsequent to an erasure concealment frame are obtained. When only one background noise frame subsequent to the erasure concealment frame is obtained, processing on this background noise frame may be the same as that on the following explained background noise frame B. By way of example, but not limitation, 7 successive background noise frames B, C, D, E, F, G, and H are illustrated in the following. That is, the previous frame of the current obtained first background noise frame B is the erasure concealment frame A, and the respective previous frames of the background noise frames except the first background noise frame B are all background noise frames. The signal corresponding to such background noise frame is a background noise signal. For example, the previous frame of the background noise frame D is the background noise frame C. Specifically, whether the current obtained frame is a background noise frame may be determined according to a flag in the frame head.

102: Energy attenuation gain values are set for the background noise signals corresponding to the obtained background noise frames B, C, D, E, F, G, and H, so that the differences between the energy attenuation gain values of the background noise signals corresponding to the background noise frames B, C, D, E, F, G, and H and the energy attenuation gain values of the signals corresponding to their respective previous frames are within a threshold range. Specifically, the step 102 may be performed as the following:

Firstly, a stored energy attenuation gain value $\alpha'$ of the erasure concealment signal corresponding to the erasure concealment frame A is obtained.

Secondly, an initial energy attenuation gain value $\alpha_{start}$ for the background noise frames is set according to the energy attenuation gain value $\alpha'$ of the erasure concealment signal corresponding to the erasure concealment frame A. The difference between the initial energy attenuation gain value $\alpha_{start}$ and the energy attenuation gain value $\alpha'$ of the erasure concealment signal corresponding to the erasure concealment frame is within the threshold range. Specifically, it may let $\alpha_{start}=\alpha'$.

Thirdly, the sum value of the initial energy attenuation gain value $\alpha_{start}$ and an energy attenuation gain added value $\Delta\alpha$ which is less than the threshold is set to the energy attenuation gain value of the background noise signal corresponding to the first background noise frame B. The sum values of the energy attenuation gain values of the signals corresponding to the respective previous background noise frames of the background noise frames, except the first background noise frame B and the energy attenuation gain added value, are separately set to the energy attenuation gain values of the background noise signals corresponding to the background noise frames except the first background noise frame B. Specifically, it may let: the energy attenuation gain value of the background noise signal corresponding to the background noise frame B $\alpha_{noiseB}=\alpha_{start}+\Delta\alpha$, that is, $\alpha_{start}$ is the precondition for $\alpha_{noiseB}$; the energy attenuation gain value of the background noise signal corresponding to the background noise frame C $\alpha_{noiseC}=\alpha_{noiseB}+\Delta\alpha$, that is, $\alpha_{noiseB}$ is the precondition for $\alpha_{noiseC}$; the energy attenuation gain value of the background noise signal corresponding to the background noise frame D $\alpha_{noiseD}=\alpha_{noiseC}+\Delta\alpha$, that is, $\alpha_{noiseC}$ is the precondition for $\alpha_{noiseD}$; the energy attenuation gain value of the background noise signal corresponding to the background noise frame E $\alpha_{noiseE}=\alpha_{noiseD}+\Delta\alpha$, that is, $\alpha_{noiseD}$ is the precondition for $\alpha_{noiseE}$; the energy attenuation gain value of the background noise signal corresponding to the background noise frame F $\alpha_{noiseF}=\alpha_{noiseE}+\Delta\alpha$, that is, $\alpha_{noiseE}$ is the precondition for $\alpha_{noiseF}$; the energy attenuation gain value of the background noise signal corresponding to the background noise frame G $\alpha_{noiseG}=\alpha_{noiseF}+\Delta\alpha$, that is, $\alpha_{noiseF}$ is the precondition for $\alpha_{noiseG}$; and the energy attenuation gain value of the background noise signal corresponding to the background noise frame H $\alpha_{noiseH}=\alpha_{noiseG}+\Delta\alpha$, that is, $\alpha_{noiseG}$ is the precondition for $\alpha_{noiseH}$.

It should be noted, when multiple successive background noise frames are obtained and an energy attenuation gain value $\alpha_{noise}$ of a background noise signal corresponding to a certain background noise frame is satisfied with $\alpha_{noise}\geqq 1$ through a similar iterative process as mentioned above, it may let $\alpha_{noise}=1$ in order to satisfy the requirement of speech signal processing. For simplicity, the above mentioned iterative process for setting the energy attenuation gain values of the background noise signals corresponding to at least two background noise frames may be expressed in the following equation:

$$\alpha_{noise}=\alpha_{noise}+\Delta\alpha$$

$$\text{if } (\alpha_{noise}\geqq 1)$$

$$\{\alpha_{noise}=1\}.$$

In an embodiment, the $\Delta\alpha$ may, but not limited to, be obtained in one of the following two ways:

$$\Delta\alpha=\frac{1}{N}, \text{ where } N \text{ is } 256;$$

$$\Delta\alpha=\frac{1-\alpha_{start}}{L},$$

where L is the preset number of background noise frames. Specifically, the value of L may be 100.

103: The energy attenuation of the background noise signals corresponding to the background noise frames B, C, D, E, F, G, and H is controlled by using the energy attenuation gain values. Specifically, the step 103 may be performed as the following:

Firstly, the background noise signals corresponding to the background noise frames B, C, D, E, F, G, and H are recovered.

Secondly, amplitude attenuation is performed on the background noise signals by using the energy attenuation gain values, such as, the amplitude attenuation is performed on the background noise signal corresponding to the background noise frame B by using the energy attenuation gain value $\alpha_{noiseB}$ of the background noise signal corresponding to the background noise frame B, the amplitude attenuation is performed on the background noise signal corresponding to the background noise frame C by using the energy attenuation gain value $\alpha_{noiseC}$ of the background noise signal corresponding to the background noise frame C, etc. Specifically, when the number of samples of the background noise signal in each background noise frame is M, the amplitude attenuation is performed on the M samples of the background noise signal corresponding to each background noise frame by using the energy attenuation gain value of the background noise signal corresponding to each background noise frame. For simplicity, the above mentioned process of performing the amplitude attenuation on the M samples of the background noise signal corresponding to each background noise frame may be expressed in the following equation, where noise(n) denotes the amplitude of the nth background noise signal sample in the M background noise signal samples:

$$\text{if } (\alpha_{noise}<1)$$

$$\text{for } (n=0;n<M;n++)$$

$$\{\text{noise}(n)=\text{noise}(n)\times\alpha_{noise}\}$$

In the method for speech signal processing according to the embodiment of the present invention as shown in FIG. 1, the step 102 ensures that the difference between the energy attenuation gain value $\alpha_{noise}$ of the background noise signal corresponding to the first background noise frame B and the energy attenuation gain value α' of the erasure concealment signal corresponding to the erasure concealment frame A is not too much, and also ensures that, when there are at least two background noise frames, the differences between the energy attenuation gain values of the background noise signals corresponding to the background noise frames C, D, E, F, G, H and the energy attenuation gain values of the background noise signals corresponding to their respective previous background noise frames are not too much. In the step 103, the energy attenuation is performed on the background noise signals corresponding to the background noise frames by using the respective energy attenuation gain values of the background noise signals corresponding to the background noise frames, so as to make the energy transition between the erasure concealment signal area and the background noise signal area natural and smooth to improve audio comfortable sensation of the listener.

Figure 3:
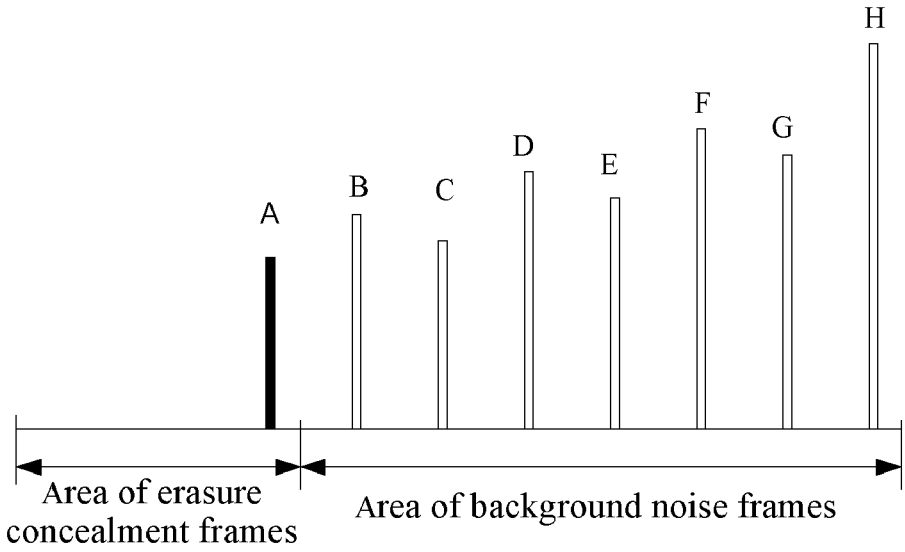
FIG. 3 is a schematic diagram of another speech signal amplitude obtained by speech signal processing according to an embodiment of the present invention.

In an embodiment, the step 102, in which energy attenuation gain values are set for the background noise signals corresponding to the obtained background noise frames B, C, D, E, F, G, and H so that the differences between the energy attenuation gain values of the background noise signals corresponding to the background noise frames B, C, D, E, F, G, and H and the energy attenuation gain values of the signals corresponding to their respective previous frames are within the threshold range, may be implemented through the speech signal processing method according to an embodiment of the present invention as shown FIG. 3.

FIG. 3 shows another speech signal amplitude obtained by speech signal processing according to an embodiment of the present invention, which is different from the speech signal amplitude obtained by the speech signal processing according to the embodiment of the present invention as shown in FIG. 2 in that, an "add 2 minus 1" method is employed. It should be noted, the following mentioned 2Δα should also be less than the threshold, such as, it may let: the energy attenuation gain value of the background noise signal corresponding to the background noise frame B, $\alpha_{noiseB}=\alpha_{start}+2\Delta\alpha$, that is, $\alpha_{start}$ is the precondition for $\alpha_{noiseB}$; the energy attenuation gain value of the background noise signal corresponding to the background noise frame C, $\alpha_{noiseC}=\alpha_{noiseB}-\Delta\alpha$, that is, $\alpha_{noiseB}$ is the precondition for $\alpha_{noiseC}$; the energy attenuation gain value of the background noise signal corresponding to the background noise frame D, $\alpha_{noiseD}=\alpha_{noiseC}+2\Delta\alpha$, that is, $\alpha_{noiseC}$ is the precondition for $\alpha_{noiseD}$; the energy attenuation gain value of the background noise signal corresponding to the background noise frame E, $\alpha_{noiseE}=\alpha_{noiseD}-\Delta\alpha$, that is, $\alpha_{noise\ D}$ is the precondition for $\alpha_{noiseE}$; the energy attenuation gain value of the background noise signal corresponding to the background noise frame F, $\alpha_{noiseF}=\alpha_{noiseE}+2\Delta\alpha$, that is, $\alpha_{noiseE}$ is the precondition for $\alpha_{noiseF}$; the energy attenuation gain value of the background noise signal corresponding to the background noise frame G, $\alpha_{noiseG}=\alpha_{noiseF}-\Delta\alpha$, that is, $\alpha_{noiseF}$ is the precondition for $\alpha_{noiseG}$; and the energy attenuation gain value of the background noise signal corresponding to the background noise frame H, $\alpha_{noiseH}=\alpha_{noiseG}+2\Delta\alpha$, that is, $\alpha_{noiseG}$ is the precondition for $\alpha_{noiseH}$.

Thus, the energy attenuation gain values of the background noise signals corresponding to the background noise frames B, C, D, E, F, G, and H are incremented in a roughly certain order until an energy attenuation gain value of a background noise signal corresponding to a background noise frame reaches 1, while the differences between the energy attenuation gain values of the background noise signals corresponding to the background noise frames B, C, D, E, F, G, and H and the respective energy attenuation gain values of the signals corresponding to their respective previous frames are ensured to be within the threshold range. Therefore, other similar implementation ways may also be considered as other embodiments of the present invention, for example the implementation ways as shown in FIG. 4.

Figure 4:
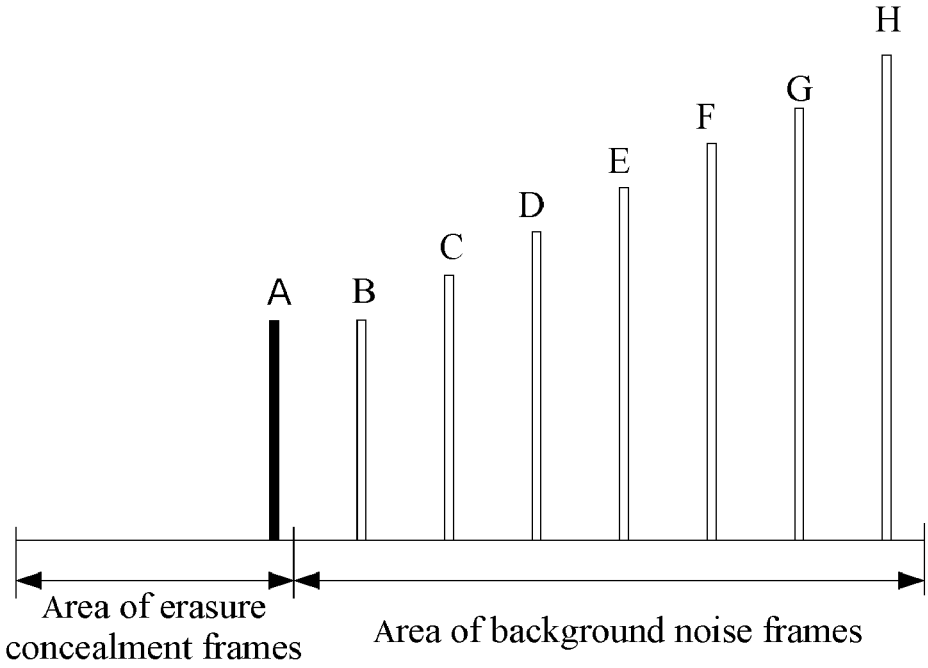
FIG. 4 is a schematic diagram of another speech signal amplitude obtained by speech signal processing according to an embodiment of the present invention.

FIG. 4 shows another speech signal amplitude obtained by speech signal processing according to an embodiment of the present invention, which is mainly different from the speech signal amplitude obtained by the speech signal processing according to the embodiment of the present invention as shown in FIG. 2 in that, the energy attenuation gain value $\alpha_{noiseB}$ of the background noise signal corresponding to the background noise frame B is equal to the value $\alpha_{start}$, and the energy attenuation gain values of the background noise signals corresponding to the background noise frames C, D, E, F, G, and H are progressively incremented by step Δα on the basis of $\alpha_{noiseB}$.

Referring to FIG. 2, a method for speech signal processing according to another embodiment of the present invention includes:

201: One or more background noise frames subsequent to an erasure concealment frame are obtained. When only one background noise frame subsequent to the erasure concealment frame is obtained, processing on this background noise frame may be the same as that on the following mentioned background noise frame B. By way of example, but not limitation, 7 successive background noise frames B, C, D, E, F, G, and H are illustrated in the following. That is, the previous frame of the current obtained first background noise frame B is the erasure concealment frame A, and the previous frames of the background noise frames except the first background noise frame B are all background noise frames. The signal corresponding to such background noise frame is a background noise signal. For example, the previous frame of the background noise frame D is the background noise frame C. Specifically, whether the current obtained frame is a background noise frame may be determined according to a flag in the frame head.

202: Energy attenuation gain values are set for the background noise signals corresponding to the obtained background noise frames B, C, D, E, F, G, and H, so that the differences between the energy attenuation gain values of the background noise signals corresponding to the background noise frames B, C, D, E, F, G, and H and the energy attenuation gain values of the signals corresponding to their respective previous frames are within a threshold range. The threshold range is a difference value range, between the energy attenuation gain values of the background noise signals corresponding to the background noise frames and the energy attenuation gain values of the signals corresponding to their respective previous frames, which is obtained according to the speech signal quality as required. This threshold is the maximum value of this difference value range. Please refer to the step 102 for the detailed implementation method of 202, which will not be described in detail here.

203: The energy attenuation of the background noise signals corresponding to the background noise frames B, C, D, E, F, G, and H is controlled by using the energy attenuation gain values. Please refer to the step 103 for the detailed implementation method of 203, which will not be described in detail here.

An apparatus for speech signal processing according to an embodiment of the present invention will be described in the following. However, the apparatus for speech signal processing according to embodiments of the present invention is not limited to the following speech decoder.

Figure 5:
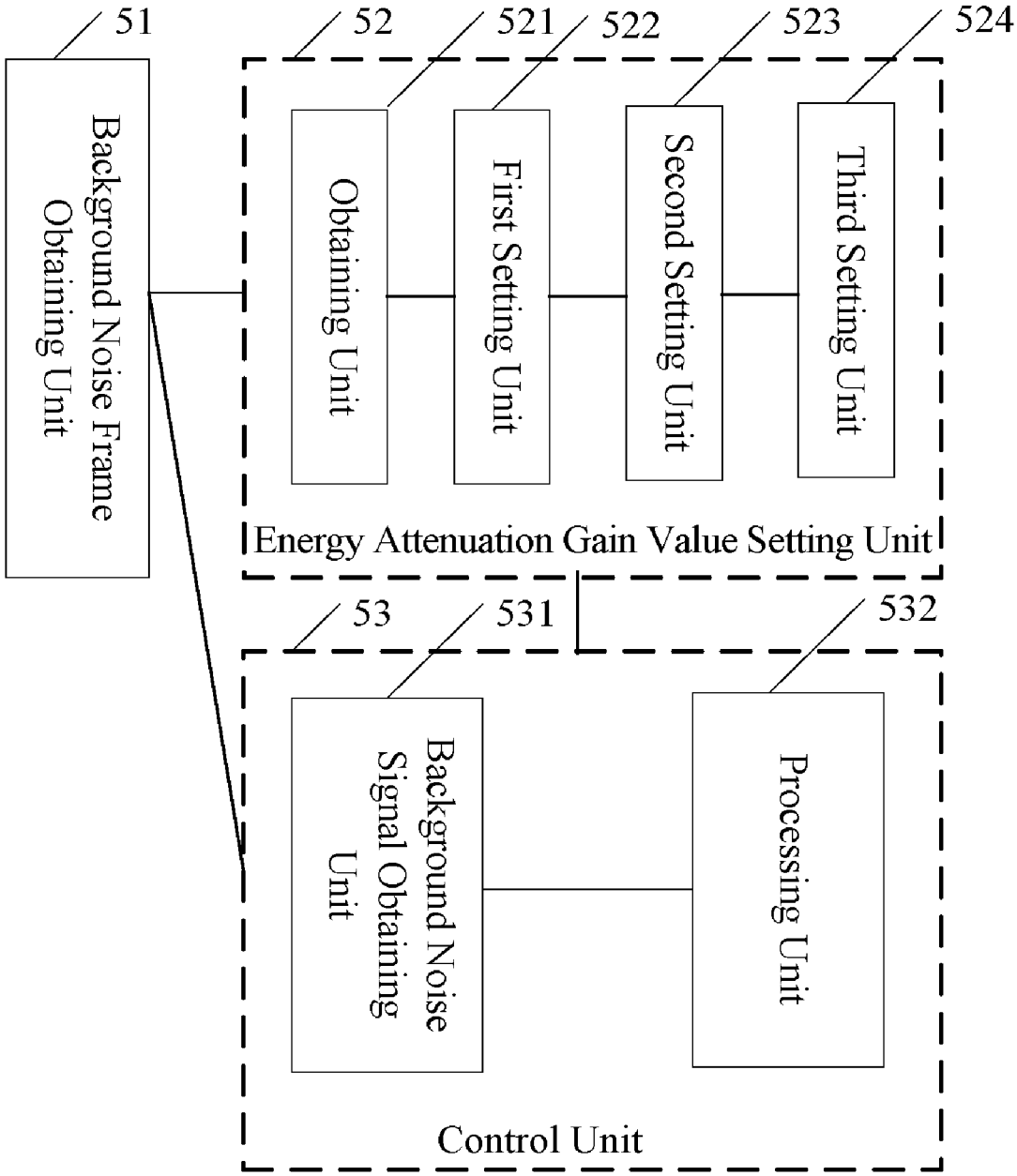
FIG. 5 is a schematic diagram of a speech decoder according to an embodiment of the present invention.

FIG. 5 is a schematic diagram of a speech decoder according to an embodiment of the present invention. Referring to FIG. 5 and FIG. 2, the apparatus as shown in FIG. 5 mainly includes a background noise frame obtaining unit 51, an energy attenuation gain value setting unit 52, and a control unit 53. The energy attenuation gain value setting unit 52 includes an obtaining unit 521, a first setting unit 522, a second setting unit 523, and a third setting unit 524. The control unit 53 includes a background noise signal obtaining unit 531 and a processing unit 532. The functions of various units are as follows:

The background noise frame obtaining unit 51 is adapted to obtain the background noise frames B, C, D, E, F, G, and H subsequent to the erasure concealment frame. That is, the previous frame of the current obtained first background noise frame B is the erasure concealment frame A, and the previous frames of the background noise frames except the first background noise frame B are all background noise frames. The signal corresponding to such background noise frame is a background noise signal. For example, the previous frame of the background noise frame D is the background noise frame C. Specifically, whether the current obtained frame is a background noise frame may be determined according to a flag in the frame head, this is known in the prior art and will not be described in detail.

The obtaining unit 521 is adapted to obtain the stored energy attenuation gain value $\alpha'$ of the erasure concealment signal corresponding to the erasure concealment frame A.

The first setting unit 522 is adapted to set the initial energy attenuation gain value $\alpha_{start}$ for the background noise frames according to the energy attenuation gain value $\alpha'$ of the erasure concealment signal corresponding to the erasure concealment frame A. The difference between the initial energy attenuation gain value $\alpha_{start}$ and the energy attenuation gain value $\alpha'$ of the erasure concealment signal corresponding to the erasure concealment frame is within the threshold range. Specifically, it may let $\alpha_{start}=\alpha'$.

The second setting unit 523 is adapted to set the sum value of the initial energy attenuation gain value $\alpha_{start}$ and the energy attenuation gain added value $\Delta\alpha$ which is less than the threshold to the energy attenuation gain value of the background noise signal corresponding to the first background noise frame B. Specifically, it may let: the energy attenuation gain value of the background noise signal corresponding to the background noise frame B, $\alpha_{noiseB}=\alpha_{start}+\Delta\alpha$, that is, $\alpha_{start}$ is the precondition for $\alpha_{noiseB}$.

The third setting unit 524 is adapted to set the sum values of the energy attenuation gain values of the signals corresponding to the previous background noise frames of the background noise frames except the first background noise frame B and the energy attenuation gain added value to the energy attenuation gain values of the background noise signals corresponding to the background noise frames except the first background noise frame B. Specifically, it may let: the energy attenuation gain value of the background noise signal corresponding to the background noise frame C, $\alpha_{noiseC}=\alpha_{noiseB}+\Delta\alpha$, that is, $\alpha_{noiseB}$ is the precondition for $\alpha_{noiseC}$; the energy attenuation gain value of the background noise signal corresponding to the background noise frame D, $\alpha_{noiseD}=\alpha_{noiseC}+\Delta\alpha$, that is, $\alpha_{noiseC}$ is the precondition for $\alpha_{noiseD}$; the energy attenuation gain value of the background noise signal corresponding to the background noise frame E, $\alpha_{noiseE}=\alpha_{noiseD}+\Delta\alpha$, that is, $\alpha_{noiseD}$ is the precondition for $\alpha_{noiseE}$; the energy attenuation gain value of the background noise signal corresponding to the background noise frame F, $\alpha_{noiseF}=\alpha_{noiseE}+\Delta\alpha$, that is, $\alpha_{noiseE}$ is the precondition for $\alpha_{noiseF}$; the energy attenuation gain value of the background noise signal corresponding to the background noise frame G, $\alpha_{noiseG}=\alpha_{noiseF}+\Delta\alpha$, that is, $\alpha_{noiseF}$ is the precondition for $\alpha_{noiseG}$; and the energy attenuation gain value of the background noise signal corresponding to the background noise frame H, $\alpha_{noiseH}=\alpha_{noiseG}+\Delta\alpha$, that is, $\alpha_{noiseG}$ is the precondition for $\alpha_{noiseH}$.

It should be noted, when multiple successive background noise frames are obtained and an energy attenuation gain value $\alpha_{noise}$ of a background noise signal corresponding to a certain background noise frame is satisfied with $\alpha_{noise}\geqq 1$ through the similar iterative process as mentioned above, it may let $\alpha_{noise}=1$ in order to satisfy the requirement of speech signal processing. For simplicity, the above mentioned iterative process for setting the energy attenuation gain values of the background noise signals corresponding to at least two background noise frames by the setting unit may be expressed in the following equation:

$$\alpha_{noise}=\alpha_{noise}+\Delta\alpha$$

$$\text{if } (\alpha_{noise}\geqq 1)$$

$$\{\alpha_{noise}=1\}$$

In an embodiment, the $\Delta\alpha$ may, but not limited to, be obtained in one of the following two ways:

$$\Delta\alpha=\frac{1}{N}, \text{ where } N \text{ is } 256;$$

$$\Delta\alpha=\frac{1-\alpha_{start}}{L},$$

where L is the preset number of background noise frames. Specifically, the value of L may be 100.

The control unit 53 is adapted to control the energy attenuation of the background noise signals corresponding to the background noise frames B, C, D, E, F, G, and H by using the energy attenuation gain values. Specifically, the control unit 53 may include a background noise signal obtaining unit 531 and a processing unit 532.

The background noise signal obtaining unit 531 is adapted to recover the background noise signals corresponding to the background noise frames B, C, D, E, F, G, and H.

The processing unit 532 is adapted to perform amplitude attenuation on the background noise signals by using the energy attenuation gain values, such as, perform amplitude attenuation on the background noise signal corresponding to the background noise frame B by using the energy attenuation gain value $\alpha_{noiseB}$ of the background noise signal corresponding to the background noise frame B, perform amplitude attenuation on the background noise signal corresponding to the background noise frame C by using the energy attenuation gain value $\alpha_{noiseC}$ of the background noise signal corresponding to the background noise frame C, and so on. Specifically, when the number of samples of the background noise signal in each background noise frame is M, amplitude attenuation is performed on the M samples of the background noise signal corresponding to each background noise frame by using the energy attenuation gain value of the background noise signal corresponding to each background noise frame. For simplicity, the process of performing amplitude attenuation on the M samples of the background noise signal corresponding to each background noise frame by the processing unit 532 may be expressed in the following equation, where noise(n) denotes the amplitude of the nth background noise signal sample in the M background noise signal samples:

if ($\alpha_{noise}<1$)

for ($n=0;n<M;n++$)

{noise($n$)=noise($n$)×$\alpha_{noise}$}

In the speech decoder according to the embodiment of the present invention as shown in FIG. 5, the energy attenuation gain value setting unit 52 is adapted to ensure that the difference between the energy attenuation gain value $\alpha_{noise}$ of the background noise signal corresponding to the first background noise frame B and the energy attenuation gain value α' of the erasure concealment signal corresponding to the erasure concealment frame A is not too much, and also ensure that, when there are at least two background noise frames, the differences between the energy attenuation gain values of the background noise signals corresponding to the background noise frames C, D, E, F, G, H and the energy attenuation gain values of the background noise signals corresponding to their respective previous background noise frames are respectively not too much. In the control unit 53, energy attenuation is performed on the background noise signals corresponding to the background noise frames by using the respective energy attenuation gain values of the background noise signals corresponding to the background noise frames, so as to make the energy transition between the erasure concealment signal area and the background noise signal area natural and smooth to improve audio comfortable sensation of the listener.

In an embodiment, the energy attenuation gain value setting unit 52 is adapted to perform the following functions: setting energy attenuation gain values for the background noise signals corresponding to the obtained background noise frames B, C, D, E, F, G, and H, so that the differences between the energy attenuation gain values of the background noise signals corresponding to the background noise frames B, C, D, E, F, G, and H and the respective energy attenuation gain values of the signals corresponding to their previous frames are within the threshold range. The energy attenuation gain value setting unit 52 may also employ the speech signal processing method according to the embodiment of the present invention as shown in FIG. 3.

The schematic diagram of another speech signal amplitude obtained by the speech signal processing according to the embodiment of the present invention as shown in FIG. 3 is different from the speech signal amplitude obtained by the speech signal processing according to the embodiment of the present invention as shown in FIG. 2 in that, an "add 2 minus 1" method is employed. It should be noted, the following mentioned 2Δα should also be less than the threshold, such as, it may let: the energy attenuation gain value of the background noise signal corresponding to the background noise frame B, $\alpha_{noiseB}=\alpha_{start}+2\Delta\alpha$, that is, $\alpha_{start}$ is the precondition for $\alpha_{noiseB}$; the energy attenuation gain value of the background noise signal corresponding to the background noise frame C, $\alpha_{noiseC}=\alpha_{noiseB}-\Delta\alpha$, that is, $\alpha_{noiseB}$ is the precondition for $\alpha_{noiseC}$; the energy attenuation gain value of the background noise signal corresponding to the background noise frame D, $\alpha_{noiseD}=\alpha_{noiseC}+2\Delta\alpha$, that is, $\alpha_{noiseC}$ is the precondition for $\alpha_{noiseD}$; the energy attenuation gain value of the background noise signal corresponding to the background noise frame E, $\alpha_{noiseE}=\alpha_{noiseD}-\Delta\alpha$, that is, $\alpha_{noiseD}$ is the precondition for $\alpha_{noiseE}$; the energy attenuation gain value of the background noise signal corresponding to the background noise frame F, $\alpha_{noiseF}=\alpha_{noiseE}+2\Delta\alpha$, that is, $\alpha_{noiseE}$ is the precondition for $\alpha_{noiseF}$; the energy attenuation gain value of the background noise signal corresponding to the background noise frame G, $\alpha_{noiseG}=\alpha_{noiseF}-\Delta\alpha$, that is, $\alpha_{noiseF}$ is the precondition for $\alpha_{noiseG}$; and the energy attenuation gain value of the background noise signal corresponding to the background noise frame H, $\alpha_{noiseH}=\alpha_{noiseG}+2\Delta\alpha$, that is, $\alpha_{noiseG}$ is the precondition for $\alpha_{noiseH}$.

Thus, the energy attenuation gain values of the background noise signals corresponding to the background noise frames B, C, D, E, F, G, and H are incremented in a roughly certain order until an energy attenuation gain value of a background noise signal corresponding to a background noise frame reaches 1, while the differences between the energy attenuation gain values of the background noise signals corresponding to the background noise frames B, C, D, E, F, G, and H and the respective energy attenuation gain values of the signals corresponding to their previous frames are ensured to be within the threshold range. Therefore, other similar ways implemented may also be considered as other embodiments of the present invention, for example, another speech signal amplitude obtained by the speech signal processing according to the embodiment of the present invention as shown in FIG. 4 may be employed in a similar way.

It should be noted as follows:

1. In the above mentioned embodiments of the present invention, the background noise frames B, C, D, E, F, G, and H are taken as example for illustration. However, the present invention is also applicable in practical conditions with more or less background noise frames.

2. The above mentioned threshold value may be chosen according to practical conditions from, but not limited to: 2Δα, 2.5 Δα, 3Δα, etc., where $$\Delta\alpha = \frac{1}{256}.$$

The initial energy attenuation gain value and the energy attenuation gain added value employed in the embodiments of the present invention may be determined according to the threshold range and the practical conditions.

When the lost frame is a background noise frame, since the energy of the erasure concealment signal obtained by the existing FEC technology may be attenuated more steeply than in the case of no background noise frame lost, if a background noise frame subsequent to the erasure concealment frame is obtained, the jump in energy transition between the area of erasure concealment signal and the area of background noise signal may be more obvious than that in the case of no background noise frame lost. In this condition, by employing embodiments of the present invention, the energy transition between the area of erasure concealment signal and the area of background noise signal may effectively be made natural and smooth, so as to improve audio comfortable sensation of the listener.

Additionally, those skilled in the art may understand that all or part flows in the above mentioned embodiments of method may be implemented by instructing related hardware with program. The program may be stored in computer readable storage media. The program, when executed, may include the flows in the above mentioned embodiments of the various methods. The storage media may be magnetic disk, optical disc, Read-Only Memory (ROM), or Random Access Memory (RAM), etc.

Specific embodiments of the present invention are described above. It should be noted that, for those skilled in the art, additional modifications and improvements may be made without departing from the principle of the present invention. These modifications and improvements should be considered as falling in the protection scope of the present invention.

What is claimed is:

1. A method for speech signal processing comprising when one or more background noise frames subsequent to an erasure concealment frame are obtained, setting, by a processor energy attenuation gain values for background noise signal corresponding to the obtained background noise frames subsequent to the erasure concealment frame, to make differences between the energy attenuation gain values of the background noise signals corresponding to the background noise frames subsequent to the erasure concealment frame and the energy attenuation gain values of signals corresponding to their respective previous frames be within a threshold range; and controlling energy attenuation of the background noise signals corresponding to the background noise frames subsequent to the erasure concealment frame by using the energy attenuation gain values.

2. The method for speech signal processing according to claim 1, wherein the setting the energy attenuation gain values for the background noise signals corresponding to the background noise frames subsequent to the erasure concealment frame comprises:

obtaining an energy attenuation gain value of an erasure concealment signal corresponding to the erasure concealment frame;

setting an initial energy attenuation gain value for the background noise frames subsequent to the erasure concealment frame according to the energy attenuation gain value of the erasure concealment signal corresponding to the erasure concealment frame, wherein the difference between the initial energy attenuation gain value and the energy attenuation gain value of the erasure concealment signal corresponding to the erasure concealment frame is within the threshold range; and setting a sum value of the initial energy attenuation gain value and an energy attenuation gain added value which is less than the threshold to an energy attenuation gain value of a background noise signal corresponding to the first one of the noise frames subsequent to the erasure concealment frame background subsequent to the erasure concealment frame.

3. The method for speech signal processing according to claim 2, further comprising when at least two background noise frames subsequent to the erasure concealment frame are obtained, setting sum values of energy attenuation gain values of signals corresponding to respective previous background noise frames of background noise frames subsequent to the erasure concealment frame except the first background noise frames subsequent to the erasure concealment frame and the energy attenuation gain added value to energy attenuation gain values of background noise signals corresponding to the background noise frames subsequent to the erasure concealment frame except the first background noise frame.

4. The method for speech signal processing according to claim 3, wherein the energy attenuation gain added value is 1/256 or a set value, wherein the set value being obtained through dividing a difference value between 1 and the initial energy attenuation gain value by a preset number of background noise frames subsequent to the erasure concealment frame.

5. The method for speech signal processing according to claim 4, wherein the preset number of background noise frames subsequent to the erasure concealment frame is 100.

6. The method for speech signal processing according to claim 1, wherein the threshold is a maximum difference range, range between the energy attenuation gain values of the background noise signals corresponding to the background noise frames subsequent to the erasure concealment frame and the energy attenuation gain values of the signals corresponding to their respective previous frames, wherein the threshold is obtained according to required speech signal quality.

7. The method for speech signal processing according to claim 1, wherein the initial energy attenuation gain value is equal to the energy attenuation gain value of the erasure concealment signal corresponding to the erasure concealment frame.

8. The method for speech signal processing according to claim 1, wherein the controlling energy attenuation of the background noise signals corresponding to the background noise frames subsequent to the erasure concealment frame by using the energy attenuation gain values comprises:

recovering the background noise signals corresponding to the background noise frames subsequent to the erasure concealment frame; and performing amplitude attenuation on the background noise signals by using the energy attenuation gain values, as expressed in the following equation:

$$\text{if } (\alpha_{noise}<1)$$

$$\text{for } (n=0;n<M;n++)$$

$$\{\text{noise}(n)=\text{noise}(n)\times\alpha_{noise}\}$$

wherein noise(n) denotes the amplitude of the nth background noise signal in the M background noise signals, $\alpha_{noise}$ denotes the energy attenuation gain value of a background noise signal corresponding to a background noise frame.

9. The method for speech signal processing according to claim 1, wherein the erasure concealment frame comprises the background noise frame subsequent to the erasure concealment on which erasure concealment processing is performed.

10. An apparatus for speech signal processing, the apparatus comprising:

a background noise frame obtaining unit implemented in a processor and adapted to obtain one or more background noise frames subsequent to an erasure concealment frame;

an energy attenuation gain value setting unit adapted to set energy attenuation gain values for background noise signals corresponding to the background noise frames subsequent to the erasure concealment frame, to make differences between the energy attenuation gain values of the background noise signals corresponding to the background noise frames subsequent to the erasure concealment frame and the energy attenuation gain values of signals corresponding to their respective previous frames be within a threshold range; and a control unit adapted to control energy attenuation of the background noise signals corresponding to the background noise frames subsequent to the erasure concealment frame by using the energy attenuation gain values.

11. The apparatus for speech signal processing according to claim 10, wherein the energy attenuation gain value setting unit comprises:

an obtaining unit adapted to obtain an energy attenuation gain value of an erasure concealment signal corresponding to the erasure concealment frame;

a first setting unit adapted to set an initial energy attenuation gain value for the background noise frames according to the energy attenuation gain value of the erasure concealment signal corresponding to the erasure concealment frame, wherein the difference between the initial energy attenuation gain value and the energy attenuation gain value of the erasure concealment signal corresponding to the erasure concealment frame is within a threshold range; and a second setting unit adapted to set a sum value of the initial energy attenuation gain value and an energy attenuation gain added value which is less than the threshold to an energy attenuation gain value of a background noise signal corresponding to the first one of the background noise frames subsequent to the erasure concealment frame.

12. The apparatus for speech signal processing according to claim 11, characterized in that, wherein when at least two background noise frames subsequent to the erasure concealment frame are obtained, the energy attenuation gain value setting unit further comprises:

a third setting unit adapted to set sum values of energy attenuation gain values of signals corresponding to respective previous background noise frames of background noise frames subsequent to the erasure concealment frame except the first background noise frames subsequent to the erasure concealment frame and the energy attenuation gain added value to energy attenuation gain values of background noise signals corresponding to the background noise frames subsequent to the erasure concealment frame except the first background noise frame.

13. The apparatus for speech signal processing according to claim 10, wherein the threshold is a maximum difference range, between the energy attenuation gain values of the background noise signals corresponding to the background noise frames subsequent to the erasure concealment frame and the energy attenuation gain values of the signals corresponding to their respective previous frames, which is obtained according to required speech signal quality.

14. The apparatus for speech signal processing according to claim 10, wherein the control unit comprises:

a background noise signal obtaining unit adapted to recover the background noise signals corresponding to the background noise frames subsequent to the erasure concealment frame; and a processing unit adapted to perform amplitude attenuation on the background noise signals by using the energy attenuation gain values, as expressed in the following equation:

$$\text{if } (\alpha_{noise}<1)$$

$$\text{for } (n=0;n<M;n++)$$

$$\{\text{noise}(n)=\text{noise}(n)\times\alpha_{noise}\}$$

wherein noise(n) denotes the amplitude of the nth background noise signal in the M background noise signals, $\alpha_{noise}$ denotes the energy attenuation gain value of a background noise signal corresponding to a background noise frames subsequent to the erasure concealment frame.

15. The apparatus for speech signal processing according to claim 10, wherein the erasure concealment frame comprises the background noise frame subsequent to the erasure concealment on which erasure concealment processing is performed.

16. The apparatus for speech signal processing according to claim 10, wherein the apparatus for speech signal processing is a speech decoder.

17. A method for speech signal processing, when one or more background noise frames subsequent to an erasure concealment frame are obtained, setting, by a processor an initial energy attenuation gain value for the background noise frames subsequent to the erasure concealment frame according to the energy attenuation gain value of the erasure concealment signal corresponding to the erasure concealment frame, setting a sum value of the initial energy attenuation gain value and an energy attenuation gain added value 1/256 to an energy attenuation gain value of a background noise signal corresponding to the first one of the background noise frames subsequent to the erasure concealment frame; and controlling energy attenuation of the background noise signals corresponding to the background noise frames subsequent to the erasure concealment frame by using the energy attenuation gain values.

18. The method for speech signal processing according to claim 17, further comprising:

when at least two background noise frames subsequent to the erasure concealment frame are obtained, setting energy attenuation gain values of background noise signals corresponding to the background subsequent to the erasure concealment frame except the first background subsequent to the erasure concealment frame, which is a sum value of energy attenuation gain values of signals corresponding to respective previous background noise frames of background noise frames subsequent to the erasure concealment frame except the first background noise frame subsequent to the erasure concealment frame and the energy attenuation gain added value.

19. The method for speech signal processing according to claim 17, wherein the controlling energy attenuation of the background noise signals corresponding to the background noise frames by using the energy attenuation gain values comprises:

recovering the background noise signals corresponding to the background noise frame subsequent to the erasure concealment frame; and performing amplitude attenuation on the background noise signals by using the energy attenuation gain values, as expressed in the following equation:

$$\text{if } (\alpha_{noise}<1)$$

$$\text{for } (n=0;n<M;n++)$$

$$\{\text{noise}(n)=\text{noise}(n)\times\alpha_{noise}\}$$

wherein noise(n) denotes the amplitude of the nth background noise signal in the M background noise signals, and $\alpha_{noise}$ denotes the energy attenuation gain value of a background noise signal corresponding to the background noise frame subsequent to the erasure concealment frame.

* * * * *

UNITED STATES PATENT AND TRADEMARK OFFICE

CERTIFICATE OF CORRECTION

PATENT NO. : 7,890,322 B2
APPLICATION NO. : 12/820738
DATED : February 15, 2011
INVENTOR(S) : Jinliang Dai et al.

It is certified that error appears in the above-identified patent and that said Letters Patent is hereby corrected as shown below:

On Title page of patent, line (30) should read:

Mar. 20, 2008 (CN) .....200810026901.2

Signed and Sealed this
Twenty-ninth Day of March, 2011

David J. Kappos

David J. Kappos
*Director of the United States Patent and Trademark Office*